United States Patent [19]

Bylenga

[11] Patent Number: 4,615,743

[45] Date of Patent: Oct. 7, 1986

[54] BAG HOLDING APPARATUS

[76] Inventor: Peter D. Bylenga, 33 Hiawatha Dr., Greenville, S.C. 29615

[21] Appl. No.: 640,227

[22] Filed: Aug. 9, 1984

Related U.S. Application Data

[63] Continuation of Ser. No. 453,823, Dec. 27, 1982, abandoned.

[51] Int. Cl.[4] ..... B08B 7/00

[52] U.S. Cl. ..... 134/6; 134/25.1; 134/25.5; 134/42; 15/257.9; 248/99

[58] Field of Search ..... 134/6, 24.1, 25.1; 15/257.1, 257.4, 257.6, 257.9; 248/99

[56] References Cited

U.S. PATENT DOCUMENTS

| | | | |
|---|---|---|---|
| 481,957 | 9/1892 | Klank | 248/99 |
| 3,711,141 | 1/1973 | Soergel | 15/257.8 X |
| 3,934,803 | 1/1976 | Paulus | 15/257.1 X |
| 3,998,415 | 12/1976 | D'Antonio et al. | 15/257.1 X |
| 4,159,139 | 6/1979 | Gawedzinski | 15/257.1 X |

*Primary Examiner*—Andrew H. Metz
*Assistant Examiner*—Sharon T. Cohen
*Attorney, Agent, or Firm*—Bailey & Hardaway

[57] ABSTRACT

A bag holding apparatus to assist in the bagging of leaves or other lawn debris comprises a generally "U" shaped member with foreshortened legs at either end thereof to maintain bag in an open position.

1 Claim, 4 Drawing Figures

BAG HOLDING APPARATUS

This application is a continuation of application Ser. No. 453,823, filed 12/27/82 abandoned.

BACKGROUND OF THE INVENTION

This invention relates generally to the art of packaging and more particularly to the art of bagging lawn debris.

Collecting and discarding leaves, grass trimmings and the like has long presented a problem which, in part has been minimized by the wide scale use of large plastic bags, which bags are economical to use and which can be easily disposed of. Plastic bags for collecting and disposing of leaves and grass trimmings have been used by home owners and the like on a substantially wide scale for a number of years. While these bags provided a convenient means for storing leaves and other disposable trash, the use of such plastic bags has in itself created additional problems, particularly with regard to filling the bags, due to the flexiblity and weakness of the bags. Users of plastic bags have for a substantial period of time been confronted with the problem of how to easily fill the bags, such as with leaves, grass trimmings and the like. The bags are extremely flexible and thus trash can be deposited into the bags only by having some means for holding the bag open, such as by suspending the plastic bag within a large metal can or drum.

While this procedure does provide adequate support for the bag, it is unsatisfactory since it requires that all the trash has to be manually lifted so as to be deposited into the bag.

One solution to this problem is described in U.S. Pat. No. 3,711,141 to Soergel wherein a frame having a radially adjustable outer member is utilized to hold a large bag open upon the ground for racking leafs into such large bags. While this was an improvement over the prior art it left many problems with respect to the placement of leaves into the bag and maintaining a bag in a desirable open relationship.

Another bag distending device is described in U.S. Pat. No. 3,934,803 to Paulus, Jr. The device described therein is a rather complex skeletal frame about which the bag is spread for purposes of filling.

SUMMARY OF THE INVENTION

It is thus an object of this invention to provide a novel bag holding apparatus which is simple and effective.

It is a still further object of this invention to provide such a bag holding apparatus which has the capablity of being sufficiently flexible to self adjust to variations in bag sizes.

It is a further object of this invention to provide such a bag holding apparatus which does not have the tendency to have the bag dislodged during the normal loading operation.

These as well other objects are accomplished by a bag holding apparatus which comprisses a generally "U" shaped member having foreshortened legs at either end therof extending in a direction substantially transverse to the plane of the "U". The bag is mounted upon the apparatus by generally extending the open end of the bag about the outer perimeter of the apparatus and then pulling the bag substantially inside out through the center of the apparatus to define an opening for the filling thereof.

DETAILED DESCRIPTION

In accordance with this invention it has been found that an apparatus with simplicity far greater than that possessed by the prior art may be utilized for holding the bag open for the purpose of depositing leaves and other lawn debris therein. In particular the apparatus maintains the bag in the open position without obstructing the entrance thereof and without transmitting forces due to the loading process which would tend to dislodge the bag from the holding apparatus. These as well as other advantages will become apparent from a reading of the following detailed description with reference to the various figures of drawing.

Figure 1:
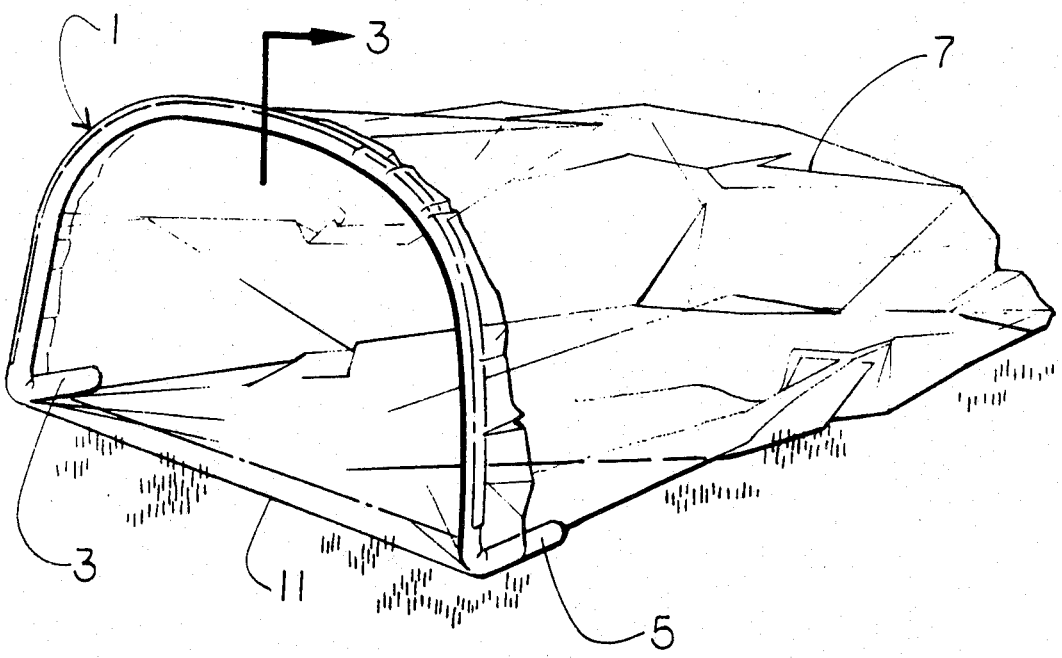
FIG. 1 of the drawings illustrates a bag holding apparatus in accordance with this invention having a bag mounted thereon.

FIG. 1 of the drawings illustrates an apparatus 1 in accordance with this invention. The apparatus 1 is essentialy a "U" shaped or semicircular shaped tube having foreshortened leg members 3 and 5 thereon which are generally transverse to the plane of the "U" shaped member. The apparatus 1 has distended thereabout a flexible plastic container 7 in the form of a large plastic bag.

Figure 2:
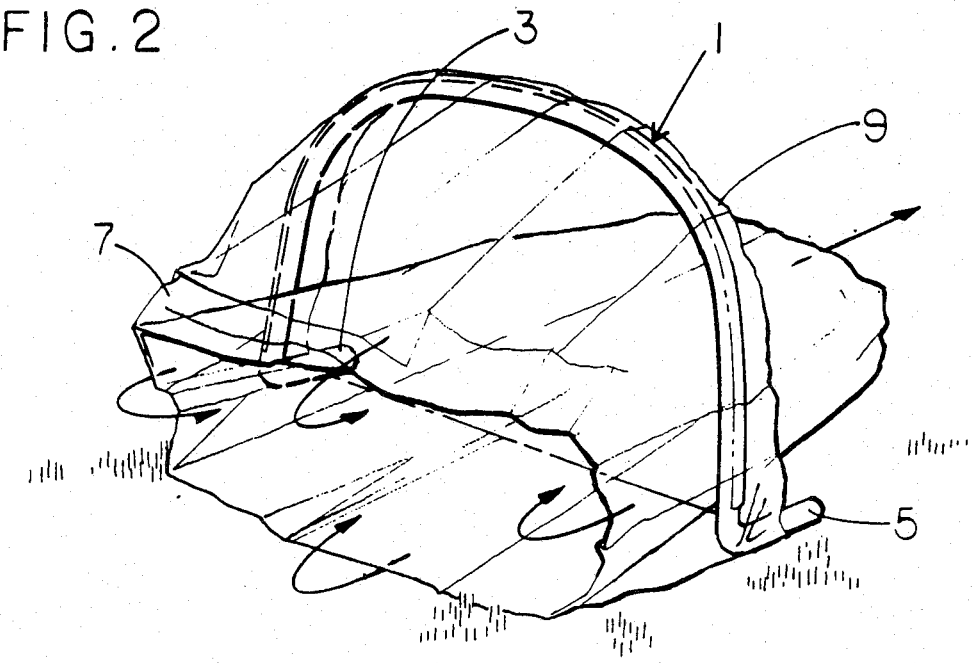
FIG. 2 of the drawings illustrates a bag holding apparatus in accordance with this invention and illustrates the placement of a bag thereon.

FIG. 2 of the drawings best illustrates the process of lodging the bag 7 about the apparatus 1. As can be seen from FIG. 2 of the drawing, the bag 7 has an opening 9 which for purposes of loading is placed about the apparatus 1. It is noted that the apparatus 1 is generally flexible and resilient such that the apparatus 1 self adjusts to the size of opening 9. Once the opening 9 is placed about the apparatus 1, the bag 7 is generally pulled inside out through the apparatus, in the direction of the arrow illustrated in FIG. 2, such that the fronting surface of the apparatus is covered by the convoluted bag as depicted in FIG. 1.

Returning again to FIG. 1 it is seen that the ground contacting portion 11 of bag 7 is formed by a folded section of the bag 7 such that the normal force associated with loading the bag tends to not dislodge the bag but to generally force the bag about the apparatus 1. Generally any force which tends to move the fold in a rearward direction would tend to collapse the apparatus 1 thus causing greater force or resiliency from the apparatus to maintain the bag in position.

Figure 3:
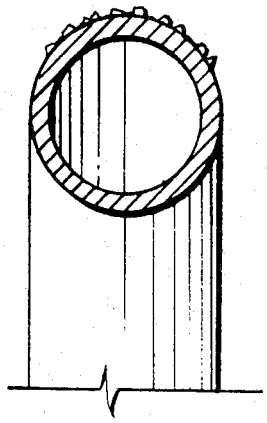
FIG. 3 of the drawings is a view along the line 3—3 of FIG. 1

It is a preferred aspect of this invention that the apparatus 1 be coated with a particulate material such as sand to further enhance the gripping of the bag by the apparatus. This is preferably brought about by merely painting the apparatus with a latex base paint having dispersed therein particles of sand or other finely divided material. This gives an outer texture similar to that of medium sand paper. This is generally illustrated in FIG. 3 of the drawing.

Figure 4:
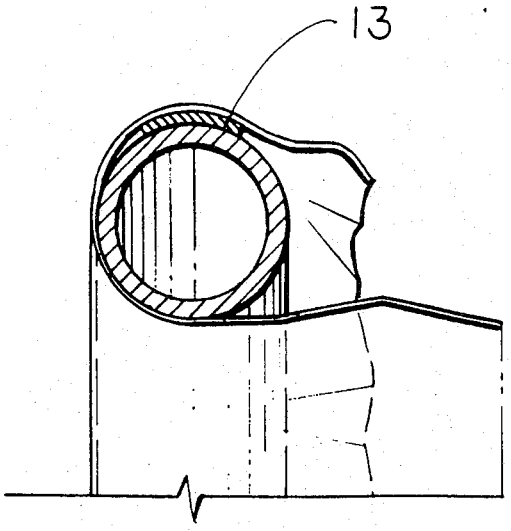
FIG. 4 is a view similar to FIG. 3 of a different embodiment

An alternative for producing friction is illustrated in FIG. 4 wherein a foam rubber pad 13 is attached to apparatus 1.

It is contemplated that the apparatus 1 of this invention be formed of a generally tubular flexible material. A one inch outer diameter polyvinyl chloride tubular material which has been heat formed to the configuration generally shown in FIG. 1 has been found to be operable for this purpose. A wall diameter for the tube of approximately $\frac{1}{8}$ inch has been found desirable and is given for exemplary purposes only.

Foreshortened legs 3 and 5 maintain the apparatus in a generally upright position to maintain the bag opening available for loading. Foreshortened legs 3 and 5 extend generally transverse to the plane of the "U" shaped member but may be somewhat pigeon toed toward the center of the bag without adverse consequences. Foreshortened legs 3 and 5 are of sufficient length to maintain the apparatus in a generally upright position as is clearly depicted in FIG. 1 of the drawings.

It is thus seen that the apparatus of this invention provides a novel bag holding apparatus without complexity which is useful for maintaining a bag on open position during loading and which does not tend to dislodge during such loading process. As many variations will become apparent to those in the art from a reading of the above description, such variations as are embodied within the spirit scope of the following appended claims are within the scope of this invention.

What is claimed is:

1. A process for removing debris from the ground comprising the steps of:

providing an apparatus which comprises;

a generally flexible "U" shaped member having an open end, said "U" shaped member having an inside surface and an outside surface, foreshortened legs at either end of said "U" shaped member extending in a direction substantially transverse to the plane of said "U" shaped member, said "U" shaped member and said foreshortened legs being discontinuous between said legs at said open end to permit flexing thereof for accommodating varying bag sizes, a plastic bag distended about said outside surface and convoluted through said inside surface of said "U" shaped member in the direction of said foreshortened legs whereby said "U" shaped member is totally enclosed within a fold of the convoluted bag, and contacts said fold on both said inside and outside surface, said plastic bag being retained in position by the flexing of said "U" shaped member within said fold; and wherein said foreshortened legs are of sufficient length to maintain the apparatus in a generally upright position so as to maintain said bag open and available for leading with debris;

placing said apparatus upon a horizontal surface with said foreshortened legs maintaining said apparatus in an upright position and with the discontinuous area between said foreshortened legs being upon said horizontal surface with only the fold in said convoluted plastic bag in the discontinuous area between said foreshortened legs defining a portion of the opening of a debris receiving receptacle adjacent to said horizontal surface; and moving debris across said horizontal surface across said fold in said discontinuous area and into the debris receiving receptacle.

* * * * *